US010118204B2

(12) United States Patent
Katsumata et al.

(10) Patent No.: US 10,118,204 B2
(45) Date of Patent: Nov. 6, 2018

(54) CLEANING APPARATUS

(71) Applicants: IHI Corporation, Tokyo (JP); IHI Machinery and Furnace Co., Ltd., Tokyo (JP)

(72) Inventors: Kazuhiko Katsumata, Inuyama (JP); Masatoshi Mitsuzuka, Kakamigahara (JP); Osamu Sakamoto, Kamo-gun (JP); Takahiro Nagata, Kamo-gun (JP)

(73) Assignees: IHI CORPORATION, Tokyo (JP); IHI MACHINERY AND FURNACE CO., LTD., Tokyo (JP)

( * ) Notice: Subject to any disclaimer, the term of this patent is extended or adjusted under 35 U.S.C. 154(b) by 0 days.

(21) Appl. No.: 15/353,284

(22) Filed: Nov. 16, 2016

(65) Prior Publication Data

US 2017/0056937 A1 Mar. 2, 2017

Related U.S. Application Data

(63) Continuation of application No. PCT/JP2015/064751, filed on May 22, 2015.

(30) Foreign Application Priority Data

Jun. 30, 2014 (JP) ..... 2014-133929

(51) Int. Cl.
*B08B 3/10* (2006.01)
*C23G 5/04* (2006.01)

(52) U.S. Cl.
CPC . *B08B 3/10* (2013.01); *C23G 5/04* (2013.01)

(58) Field of Classification Search
CPC ..... B08B 3/10; C23G 5/04
See application file for complete search history.

(56) References Cited

U.S. PATENT DOCUMENTS

| | | | | |
|---|---|---|---|---|
| 5,143,103 | A * | 9/1992 | Basso et al. | 134/98.1 |
| 5,709,757 | A * | 1/1998 | Hatano et al. | 134/22.14 |
| 6,158,449 | A * | 12/2000 | Kamikawa | 134/61 |
| 2006/0219274 | A1* | 10/2006 | Iwata | 134/61 |
| 2009/0120464 | A1* | 5/2009 | Rasheed et al. | 134/21 |
| 2014/0246056 | A1 | 9/2014 | Hiramoto et al. | |

FOREIGN PATENT DOCUMENTS

| | | | |
|---|---|---|---|
| JP | 04-179192 | A | 6/1992 |
| JP | 07-256221 | A | 10/1995 |
| JP | 10-057909 | A | 3/1998 |
| JP | 11-159977 | A | 6/1999 |
| JP | 2001-321417 | A | 11/2001 |
| JP | 2006-049408 | A | 2/2006 |
| JP | 2010-123835 | A | 6/2010 |
| JP | 2011131216 | A | 7/2011 |
| JP | 2013202566 | A | 10/2013 |
| JP | 2014-073453 | A | 4/2014 |
| WO | 2013/077336 | A1 | 5/2013 |

* cited by examiner

*Primary Examiner* — Michael E Barr
*Assistant Examiner* — Benjamin L Osterhout
(74) *Attorney, Agent, or Firm* — Rothwell, Figg, Ernst & Manbeck, P.C.

(57) ABSTRACT

A cleaning apparatus includes: a cleaning chamber that accommodates an object to be cleaned; a drying chamber connected to the cleaning chamber; a connecting member connecting a first opening provided in the cleaning chamber and a second opening provided in the drying chamber; a valve element positioned inside the cleaning chamber and facing the first opening; a valve seat facing the valve element; and an actuator that drives the valve element.

7 Claims, 3 Drawing Sheets

CLEANING APPARATUS

CROSS-REFERENCE TO RELATED APPLICATIONS

This application is a Continuation Application based on International Application No. PCT/JP2015/064751, filed May 22, 2015, which claims priority on Japanese Patent Application No. 2014-133929, filed Jun. 30, 2014, the contents of which are incorporated herein by reference.

TECHNICAL FIELD

The present disclosure relates to a cleaning apparatus.

BACKGROUND

Patent Document 1 discloses a vacuum cleaning apparatus including a vapor chamber that generates vapor of a hydrocarbon-based cleaning agent, a cleaning chamber that cleans a workpiece under a reduced pressure with the vapor of the hydrocarbon-based cleaning agent supplied from the vapor chamber, and a drying chamber that is connected to the cleaning chamber through an opening-and-closing valve and is maintained in a pressure-reduced state and a low-temperature state, and after the cleaning of the workpiece in the cleaning chamber is finished, the vacuum cleaning apparatus makes the cleaning chamber and the drying chamber communicate with each other by bringing the opening-and-closing valve a valve-opened state, and thereby dries the workpiece.

That is, in the vacuum cleaning apparatus, the drying chamber maintained in a pressure-reduced state communicates with the cleaning chamber being in a higher-pressure state due to supply of vapor during cleaning than the drying chamber, the pressure inside the cleaning chamber is rapidly reduced, thereby a cleaning liquid (a cleaning agent) adhering to the workpiece instantaneously vaporizes, and vapor moves from the cleaning chamber into the drying chamber and condenses thereat, whereby the drying of the workpiece is performed. Patent Document 2 also discloses a vacuum cleaning apparatus including a drying chamber (a condensing chamber) similar to that of Patent Document 1.

Patent Documents 3 to 6 disclose cleaning apparatuses and cleaning methods by which a workpiece is cleaned with a cleaning liquid.

DOCUMENT OF RELATED ART

Patent Document

[Patent Document 1] Japanese Unexamined Patent Application, First Publication No. 2014-073453

[Patent Document 2] PCT International Publication No. 2013/077336

[Patent Document 3] Japanese Unexamined Patent Application, First Publication No. 2013-202566

[Patent Document 4] Japanese Unexamined Patent Application, First Publication No. 2011-131216

[Patent Document 5] Japanese Unexamined Patent Application, First Publication No. H7-256221

[Patent Document 6] Japanese Unexamined Patent Application, First Publication No. 2001-321417

SUMMARY

Technical Problem

In the related art disclosed in Patent Document 1 or the like, the pressure inside the cleaning chamber is rapidly reduced, and thereby the cleaning liquid adhering to the workpiece is vaporized. Since this rapid pressure reduction is performed when the cleaning chamber and the drying chamber are switched from a non-communicating state to a communicating state, minimizing of the volume of the cleaning chamber has an effect. If the volume of the cleaning chamber is reduced, it is possible to reliably dry the workpiece.

The present disclosure has been made in view of the above circumstances, and an object thereof is to more easily dry a workpiece than the related art.

Solution to Problem

In order to reach the above object, a first aspect of the present disclosure is a cleaning apparatus including: a cleaning chamber that accommodates an object to be cleaned; a drying chamber connected to the cleaning chamber; a connecting member connecting a first opening provided in the cleaning chamber and a second opening provided in the drying chamber; a valve element positioned inside the cleaning chamber and facing the first opening; a valve seat facing the valve element; and an actuator that drives the valve element.

A second aspect of the present disclosure is the cleaning apparatus of the first aspect further including an opening-and-closing mechanism that switches between a communicating state and a non-communicating state, the connecting state between the cleaning chamber and the drying chamber through the connecting member. The valve seat includes the first opening. In addition, the opening-and-closing mechanism includes the valve element, the valve seat and the actuator and is configured to allow the cleaning chamber and the drying chamber to communicate with each other by separating the valve element and the valve seat from each other.

A third aspect of the present disclosure is the cleaning apparatus of the first or second aspect further including a supporting member that slidably fits into the first opening and determines the position of the valve element with respect to the first opening.

A fourth aspect of the present disclosure is that in the cleaning apparatus of any one of the first to third aspects, the actuator is provided in the drying chamber and is connected to the valve element inside the connecting member.

A fifth aspect of the present disclosure is that in the cleaning apparatus of any one of the first to fourth aspects, the connecting member is a bellows.

A sixth aspect of the present disclosure is that in the cleaning apparatus of any one of the first to fifth aspects, the valve element is configured to be movable relative to the object to be cleaned accommodated inside the cleaning chamber.

Effects

According to the present disclosure, since the cleaning chamber and the drying chamber communicate with each other when the valve element positioned inside the cleaning chamber is separated from the valve seat of the first opening, it is possible to easily dry a workpiece.

DESCRIPTION OF EMBODIMENTS

Hereinafter, an embodiment of the present disclosure is described with reference to the drawings.

Figure 1:
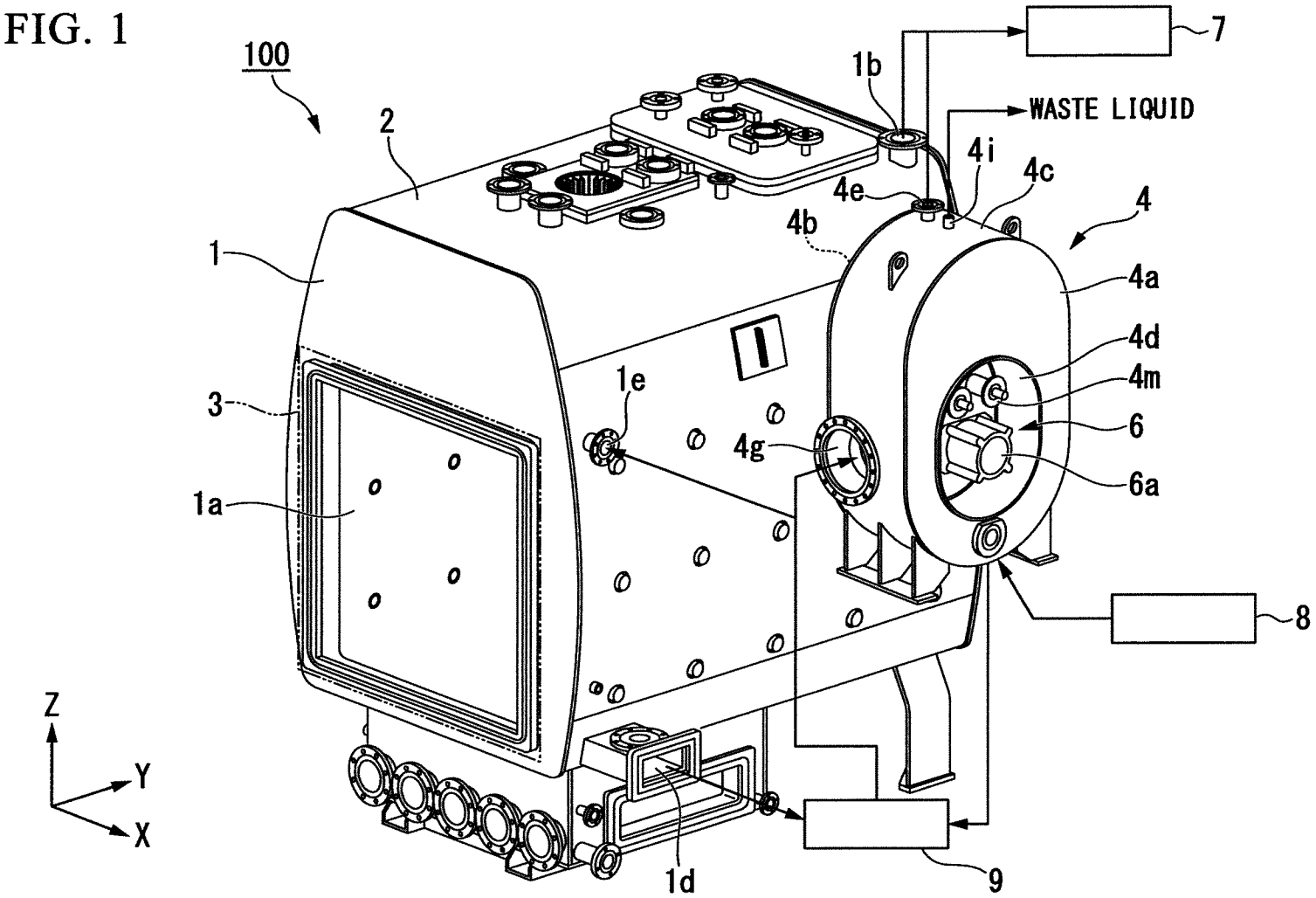
FIG. 1 is a perspective view showing an overall schematic configuration of a vacuum cleaning apparatus of an embodiment of the present disclosure.
Figure 2:
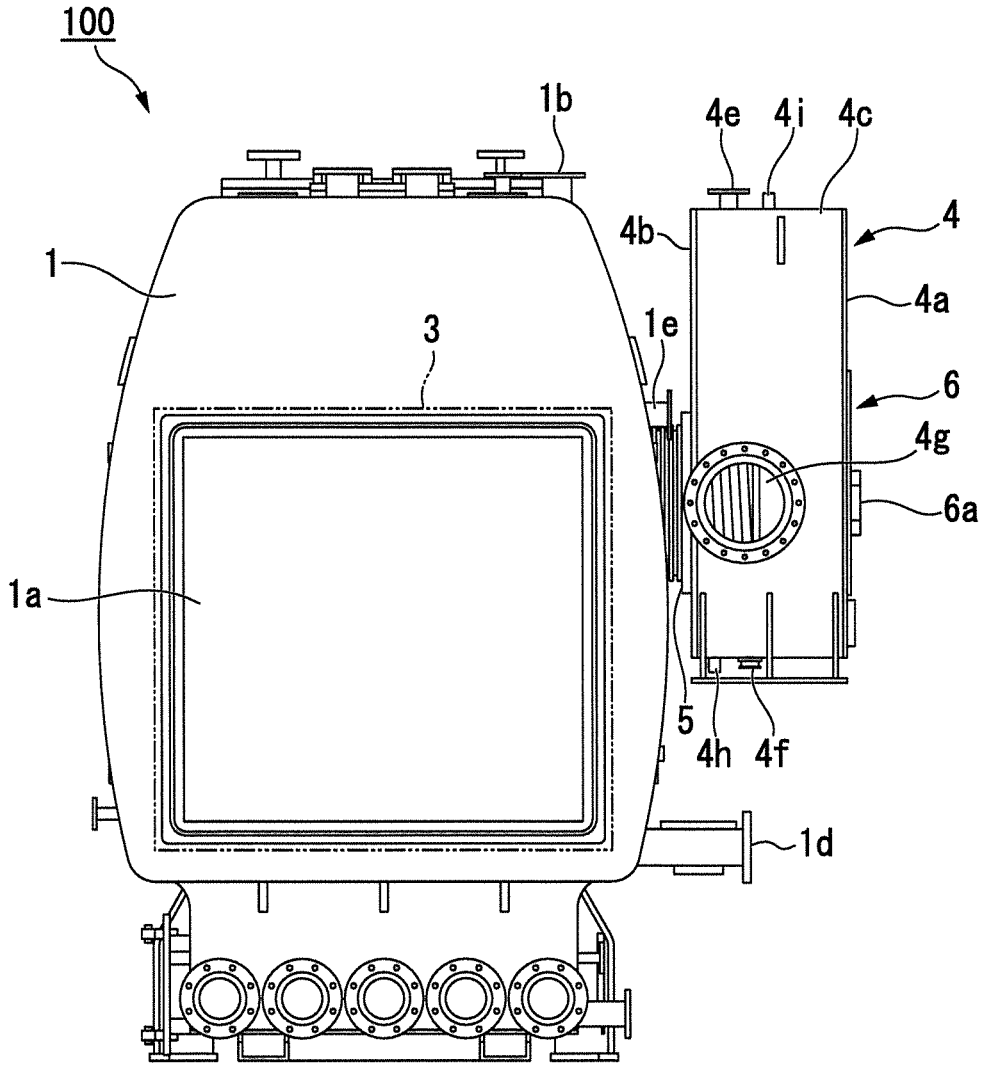
FIG. 2 is a front view showing a schematic configuration of the vacuum cleaning apparatus of the embodiment of the present disclosure.
Figure 3:
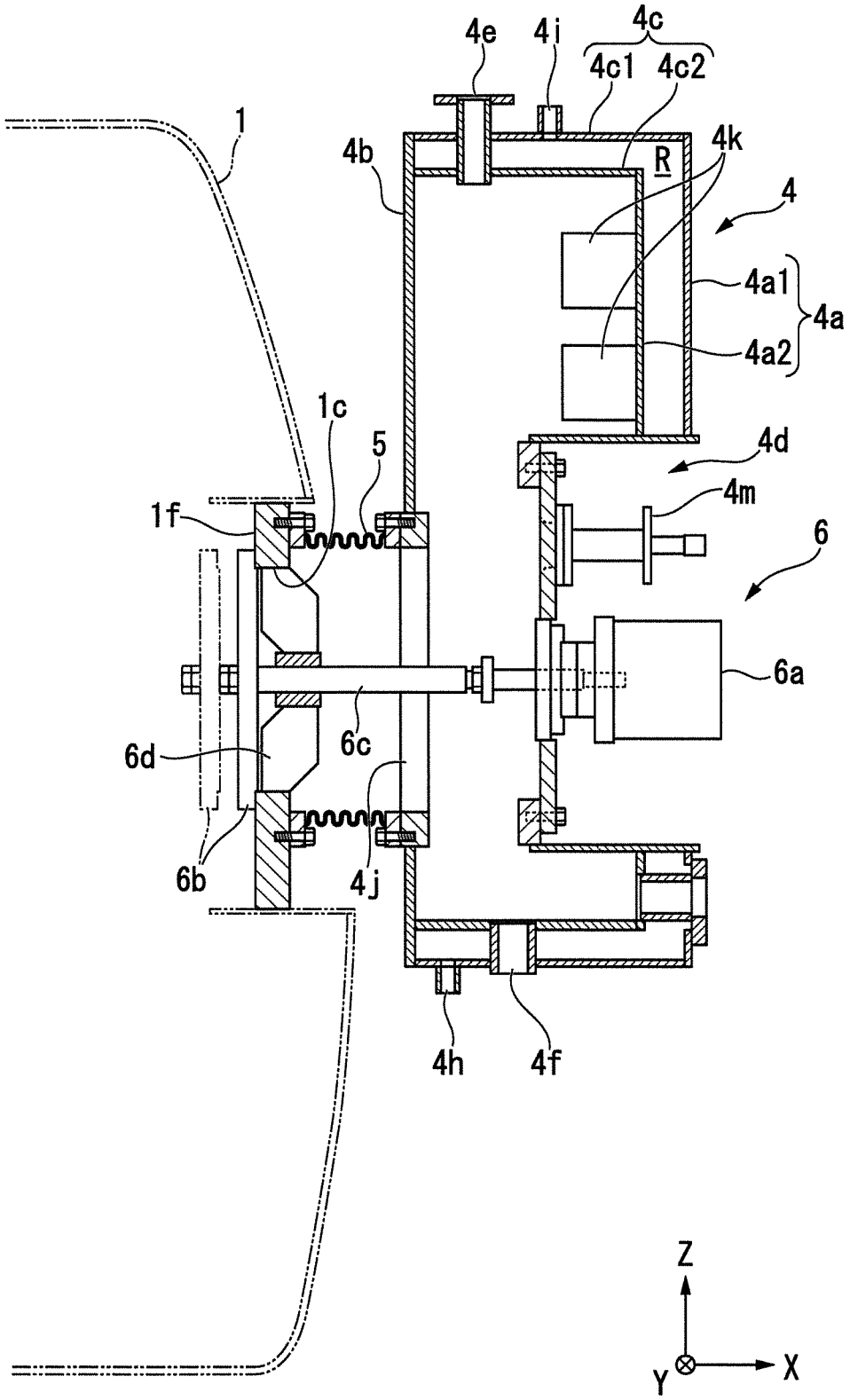
FIG. 3 is a cross-sectional view showing a detailed structure of an opening-and-closing mechanism of the vacuum cleaning apparatus of the embodiment of the present disclosure.

As shown in FIGS. 1 to 3, a vacuum cleaning apparatus 100 of this embodiment includes a cleaning chamber 1, a vapor generator 2, a front door 3, a drying chamber 4, a connecting member 5, an opening-and-closing mechanism 6, a vacuum pump 7, a refrigerant supplier 8 and a recycling condenser 9.

First, an outline of the vacuum cleaning apparatus 100 is described. The vacuum cleaning apparatus 100 is an apparatus that cleans a workpiece (an object to be cleaned), to which a dirt substance adheres, by allowing vapor (cleaning vapor) of a cleaning agent to act on the workpiece. That is, the vacuum cleaning apparatus 100 continuously supplies the cleaning vapor into the cleaning chamber for a predetermined period (a cleaning period), thereby allows the cleaning vapor to continuously contact and condense at the surface of the workpiece accommodated in the cleaning chamber, and thus cleans the dirt substance adhering to the surface of the workpiece off the surface of the workpiece along with a condensate liquid of the cleaning agent. The workpiece is a metal member in which a dirt substance such as cutting oil adheres to the surface thereof through, for example, machining.

The vacuum cleaning apparatus 100 is placed on a predetermined base (not shown) so that the Z-axis of the X, Y and Z-axes shown in FIG. 1 as orthogonal coordinate axes extends in the vertical direction. In FIG. 1, parts such as various pipes and valves, which do not directly concern features of the vacuum cleaning apparatus 100 of this embodiment, are omitted for the sake of convenience. In an actual vacuum cleaning apparatus (a real apparatus), pipes and valves are provided around the above-described components, and furthermore, exterior parts are provided outside thereof.

The entire cleaning chamber 1 is formed into a hollow rectangular parallelepiped (an approximate box shape), and the internal space thereof accommodates the workpiece. A side surface (the front surface (the surface on the left and near side thereof in FIG. 1)) of the cleaning chamber 1 is provided with an opening (a workpiece passage opening 1*a*). The workpiece passage opening 1*a* is an opening that is disposed in a vertical attitude and through which the workpiece is loaded and unloaded between the inside and outside of the cleaning chamber 1, and has a rectangular shape as shown in the drawings. That is, the workpiece passage opening 1*a* is formed so that the opening direction thereof is parallel to a horizontal direction. In addition, a seal material that is brought into close contact with the front door 3 is provided around the entire circumference of the workpiece passage opening 1*a* on the outside of the cleaning chamber 1.

An emission port 1*b* is provided in part of the top of the cleaning chamber 1 close to the rear surface (the surface on the right and far side thereof in FIG. 1). The emission port 1*b* is an opening used for emitting air (gas) inside the cleaning chamber 1 into the outside thereof, and is connected to the vacuum pump 7 through a pipe (not shown). A side portion (the side portion on the right and near side in FIG. 1) of the cleaning chamber 1 is provided with a drying chamber-connected opening 1*c* (a first opening, refer to FIG. 3), a drainage port 1*d* and a vapor intake port 1*e*.

As shown in FIG. 3, the drying chamber-connected opening 1*c* is provided so as to face the drying chamber 4 and is a circular opening that allows the cleaning chamber 1 and the drying chamber 4 to communicate with each other. The drying chamber-connected opening 1*c* may have a shape other than circles (for example, a polygonal shape). The drying chamber-connected opening 1*c* opens at the internal surface (the surface facing the inside of the cleaning chamber 1, the surface on the left side in FIG. 3) of a ring-shaped member 1*f* (a valve seat) that has a predetermined thickness (a predetermined depth) and is provided in the cleaning chamber 1 so as to face the drying chamber 4. The internal space of the cleaning chamber 1 communicates with the internal space of the drying chamber 4 through the drying chamber-connected opening 1*c*.

The ring-shaped member 1*f* includes the drying chamber-connected opening 1*c* and functions as a valve seat facing a valve element 6*b* of the opening-and-closing mechanism 6 described below. That is, the valve element 6*b* and the ring-shaped member 1*f* (the valve seat) as a unit configure an opening-and-closing valve.

The drainage port 1*d* is an opening used for discharging into the outside of the cleaning chamber 1, a mixed liquid of the cleaning liquid and the dirt substance produced through cleaning of the workpiece, and is connected to the recycling condenser 9 through a pipe (not shown). The vapor intake port 1*e* is an opening through which vapor of the cleaning agent generated by the recycling condenser 9 is taken into the cleaning chamber 1 and is connected to the recycling condenser 9 through a pipe (not shown).

The vapor generator 2 is provided in the upper part of the cleaning chamber 1 and generates vapor of the cleaning agent. The vapor generator 2 includes, for example, a heating portion (not shown) that heats the cleaning liquid and generates the cleaning vapor, and a vapor tank (not shown) that temporarily stores the cleaning vapor. The vapor generator 2 temporarily stores vapor generated by the heating portion in the vapor tank, and supplies the cleaning vapor into the cleaning chamber 1 via the vapor tank. Since the vapor generator 2 includes the vapor tank, it is possible to stably supply a predetermined flow volume of the cleaning vapor into the cleaning chamber during the cleaning period.

The cleaning agent is a hydrocarbon-based cleaning agent such as normal paraffin-based, isoparaffin-based, naphthene-based, or aromatic-based cleaning agent. Specifically, the cleaning agent is a third-petroleum cleaning agent called "cleaning solvent" such as Teclean® NG20, Clean Sol G, or Daphne Solvent.

The front door 3 is a plate-shaped member that is provided on the front surface of the cleaning chamber 1 and closes and opens the workpiece passage opening 1*a*. The front door 3 is, for example, a slide door, and is disposed facing the workpiece passage opening 1*a* so as to be in a vertical attitude (an attitude of extending in the vertical direction) similar to the workpiece passage opening 1*a* disposed in the vertical attitude. The front door 3 closes and opens the workpiece passage opening 1*a* by moving in the left-and-right direction (the X-axis direction) while maintaining the vertical attitude. In addition, the front door 3 contacts the seal material provided around the circumference of the workpiece passage opening 1*a* on the outside of the cleaning chamber 1 (the side thereof close to the front door 3), and thereby seals the cleaning chamber 1.

The drying chamber 4 is a condenser that has a roundish box shape as shown in FIG. 1 and condenses (liquefies) vapor (remaining vapor) taken thereinto from the cleaning chamber 1. When the cleaning of the workpiece at the cleaning chamber 1 is finished, the surface of the workpiece and the internal surface of the cleaning chamber 1 are wet with the cleaning liquid. Although described below in detail, the drying chamber 4 takes thereinto from the cleaning chamber 1, vapor (remaining vapor) of the cleaning agent remaining in the cleaning chamber 1 after the cleaning of the workpiece, and condenses (liquefies) the vapor.

As also shown in FIGS. 2 and 3, the drying chamber 4 includes a first flat surface portion 4*a*, a second flat surface portion 4*b*, a circumferential surface portion 4*c*, a recessed portion 4*d*, an emission port 4*e*, a drainage port 4*f*, a vapor intake port 4*g*, a refrigerant intake port 4*h*, a refrigerant drainage port 4*i*, a vapor intake opening 4*j* (a second opening), a plurality of fins 4*k* and a temperature-maintaining device 4*m*.

The first flat surface portion 4*a* is a plate-shaped member whose outer circumference forms an oval shape and whose surface facing the inside of the drying chamber 4 is provided with the fins 4*k*. As shown in FIG. 3, the first flat surface portion 4*a* includes a double shell structure formed of an outer wall 4*a*1 and an inner wall 4*a*2 that face each other with a predetermined distance therebetween, and a flow passageway (a refrigerant flow passageway R) through which a refrigerant flows is formed between the outer wall 4*a*1 and the inner wall 4*a*2.

The second flat surface portion 4*b* is a plate-shaped member that is parallel to the first flat surface portion 4*a* and is provided with the vapor intake opening 4*j* penetrating therethrough in the thickness direction thereof. That is, the second flat surface portion 4*b* is a plate-shaped member whose outer circumference forms an oval shape similar to the first flat surface portion 4*a*. In addition, the first and second flat surface portions 4*a* and 4*b* parallel to each other are disposed in vertical attitudes (attitudes of extending in the vertical direction).

The circumferential surface portion 4*c* is an endless (annular) plate-shaped member that connects the outer circumferential edges of the first and second flat surface portions 4*a* and 4*b*. As shown in FIG. 3, the circumferential surface portion 4*c* includes a double shell structure formed of an outer circumferential wall 4*c*1 and an inner circumferential wall 4*c*2 that face each other with a predetermined distance therebetween, and a flow passageway (the refrigerant flow passageway R) through which the refrigerant flows is formed between the outer circumferential wall 4*c*1 and the inner circumferential wall 4*c*2.

That is, in the drying chamber 4, the first flat surface portion 4*a* and the circumferential surface portion 4*c* include the double shell structures, and the inner wall 4*a*2 and the inner circumferential wall 4*c*2 are efficiently cooled by the refrigerant flow passageway R (the refrigerant flowing through the refrigerant flow passageway R) formed of the double shell structures. The refrigerant flow passageway R communicates with the refrigerant intake port 4*h* and the refrigerant drainage port 4*i*. In the drying chamber 4, the internal space thereof formed by the first flat surface portion 4*a*, the second flat surface portion 4*b* and the circumferential surface portion 4*c* is configured as a condensing chamber.

As shown in FIG. 1, the recessed portion 4*d* is a portion having a predetermined area that is recessed and whose center is positioned slightly below the center of the first flat surface portion 4*a*. The bottom (part of the first flat surface portion 4*a*) of the recessed portion 4*d* is attached with part of the opening-and-closing mechanism 6 (for example, an air cylinder 6*a*).

The emission port 4*e* is an opening used for emitting air (gas) inside the drying chamber 4 into the outside thereof, and is connected to the vacuum pump 7 through a pipe (not shown). The drainage port 4*f* is an opening used for draining condensate liquid (remaining condensate liquid) produced through condensation of remaining vapor inside the drying chamber 4 into the outside thereof, and is connected to the recycling condenser 9 through a pipe (not shown).

The vapor intake port 4*g* is an opening through which vapor (recycled vapor) of the cleaning agent generated by the recycling condenser 9 is taken into the drying chamber 4 and is connected to the recycling condenser 9 through a pipe (not shown). The refrigerant intake port 4*h* is an opening through which a refrigerant is taken into the refrigerant flow passageway R and is connected to the refrigerant supplier 8 through a pipe (not shown). The refrigerant drainage port 4*i* is an opening used for draining the refrigerant inside the refrigerant flow passageway R into the outside of the drying chamber 4 and is connected to a waste liquid tank (not shown) through a pipe (not shown).

As shown in FIG. 3, the vapor intake opening 4*j* is a circular opening having a predetermined size and provided in the second flat surface portion 4*b*. The shape of the vapor intake opening 4*j* may be a shape other than circles (for example, a polygonal shape). The vapor intake opening 4*j* is provided in an area corresponding to the recessed portion 4*d* provided in the first flat surface portion 4*a*, that is, is provided in the area whose center is positioned slightly below the center of the oval second flat surface portion 4*b*. The vapor intake opening 4*j* of this embodiment is formed so as to face the recessed portion 4*d* of the first flat surface portion 4*a* in a horizontal direction.

As shown in FIG. 3, the fins 4*k* are rectangular plate-shaped members provided on the inner wall 4*a*2 of the first flat surface portion 4*a* so as to protrude therefrom toward the inside of the drying chamber 4. Specifically, the fins 4*k* are provided only in an upper area of the recessed portion 4*d* within the first flat surface portion 4*a* at predetermined intervals in the vertical direction (the Z-axis direction) and in a horizontal direction so as to extend in the vertical direction.

The temperature-maintaining device 4*m* is a device that maintains the drying chamber temperature (the temperature inside the drying chamber) in a predetermined temperature lower than the cleaning chamber temperature (the temperature inside the cleaning chamber) and is provided in the recessed portion 4*d* (the first flat surface portion 4*a*) as shown in FIG. 1. Specifically, the temperature-maintaining device 4*m* maintains the drying chamber temperature in a lower temperature than the cleaning chamber temperature using cooling pipes extending inside the drying chamber 4. The drying chamber temperature set and maintained by the temperature-maintaining device 4*m* is, for example, 5° C. to 50° C. Additionally, the drying chamber temperature is set to and maintained in a predetermined temperature by supply of a refrigerant from the refrigerant supplier 8 into the refrigerant flow passageway R in addition to the temperature-maintaining device 4*m*.

The connecting member 5 is a cylindrical member connecting the drying chamber-connected opening 1*c* of the cleaning chamber 1 and the vapor intake opening 4*j* of the drying chamber 4, and is provided so that the axis direction (the central axis direction) thereof is parallel to a horizontal direction (the X-axis direction). The connecting member 5 is, for example, a cylindrical metal bellows, and is interposed between the drying chamber-connected opening 1*c* and the vapor intake opening 4*j*. In the vacuum cleaning apparatus 100 of this embodiment, since the connecting member 5 is the metal bellows, the impact of the thermal deformation (particularly, the deformation in a horizontal direction) of the cleaning chamber 1 against the drying chamber 4 is reduced.

The opening-and-closing mechanism 6 is a mechanism that switches between a communicating state and a non-communicating state, the relationship between the cleaning chamber 1 and the drying chamber 4 connected through the connecting member 5. As shown in FIG. 3, the opening-and-closing mechanism 6 is configured of the air cylinder 6*a* (an actuator), the valve element 6*b*, a connecting shaft 6*c*, a supporting member 6*d*, the ring-shaped member 1*f* and the like. It is to be noted that the ring-shaped member 1*f* is a component of the cleaning chamber 1 and is also a component of the opening-and-closing mechanism 6.

That is, the opening-and-closing mechanism 6 is a mechanism that closes and opens the drying chamber-connected opening 1*c* provided in the cleaning chamber 1 so as to face the drying chamber 4, and thereby switches between a communicating state and a non-communicating state, the connecting state between the cleaning chamber 1 and the drying chamber 4 through the connecting member 5. The air cylinder 6*a* is an actuator that drives the valve element 6*b* and is provided in the recessed portion 4*d* (the first flat surface portion 4*a*) so that the protruding direction of the movable rod thereof is parallel to the axis direction (the X-axis direction) of the connecting member 5.

The valve element 6*b* is a circular member (a circular plate member) having a slightly greater size than that of the drying chamber-connected opening 1*c* and is disposed at an inner position inside the cleaning chamber 1 than the drying chamber-connected opening 1*c*, that is, is positioned inside the cleaning chamber 1, so as to face the drying chamber-connected opening 1*c*. The valve element 6*b* is attached with the end of the connecting shaft 6*c* so that the connecting shaft 6*c* protrudes from the valve element 6*b* toward a side of the drying chamber-connected opening 1*c* close to the connecting member 5 (to the drying chamber 4). A seal member (an O-ring, not shown) is provided on the surface (the surface facing the ring-shaped member 1*f*) of the valve element 6*b* close to the drying chamber-connected opening 1*c*. It is to be noted that the seal member may be provided on the ring-shaped member 1*f*.

The valve element 6*b* is configured to be movable relative to the workpiece (an object to be cleaned) accommodated in the cleaning chamber 1. That is, in a state where the workpiece is placed inside the cleaning chamber 1, when the valve element 6*b* moves, the connecting state between the cleaning chamber 1 and the drying chamber 4 is switched between the communicating state and the non-communicating state. Although described below, the valve element 6*b* is configured to contact the ring-shaped member if during cleaning of the workpiece accommodated in the cleaning chamber 1, and in other words, at the time the valve element 6*b* closes the drying chamber-connected opening 1*c*, both of the valve element 6*b* and the workpiece are placed inside the cleaning chamber 1.

As shown in FIG. 3, the connecting shaft 6*c* is a rod-shaped member having a predetermined length, which is provided inside the connecting member 5 and is interposed between the movable rod of the air cylinder 6*a* and the valve element 6*b*, and connects the movable rod and the valve element 6*b*. That is, the air cylinder 6*a* is connected to the valve element 6*b* through the connecting shaft 6*c* inside the connecting member 5.

The supporting member 6*d* is a circular member provided on the connecting shaft 6*c* so as to be adjacent to the valve element 6*b*, and determines the position (the position within the Y-Z plane) of the valve element 6*b* with respect to the ring-shaped member 1*f* (the drying chamber-connected opening 1*c*). That is, the supporting member 6*d* slidably fits into the drying chamber-connected opening 1*c* having a predetermined depth, and thereby guides the valve element 6*b* so that the entire circumferential edge of the valve element 6*b* positioned at an inner position of the ring-shaped member 1*f* inside the cleaning chamber 1 reliably contacts the internal surface of the ring-shaped member 1*f*. The external shape of the supporting member 6*d* is formed to be approximately the same as the shape of the drying chamber-connected opening 1*c*, and part of the supporting member 6*d* close to the drying chamber 4 is provided with a diameter-reduced portion whose diameter gradually decreases toward the drying chamber 4. Since the diameter-reduced portion is provided therein, the supporting member 6*d* can be easily and appropriately inserted into the drying chamber-connected opening 1*c*, and when the radially outer part of the supporting member 6*d* fits into the drying chamber-connected opening 1*c*, the positioning of the valve element 6*b* with respect to the drying chamber-connected opening 1*c* is performed. In this embodiment, although the supporting member 6*d* is connected to the valve element 6*b* through the connecting shaft 6*c*, the supporting member 6*d* may be directly attached to the valve element 6*b*.

In the opening-and-closing mechanism 6, the air cylinder 6*a* operates so as to pull the movable rod, and thereby the valve element 6*b* contacts the internal surface of the ring-shaped member 1*f* and thus closes the drying chamber-connected opening 1*c*. On the other hand, in the opening-and-closing mechanism 6, the air cylinder 6*a* operates so as to protrude the movable rod, and thereby the valve element 6*b* is separated from the internal surface (a side surface of the cleaning chamber 1) of the ring-shaped member 1*f* and thus opens the drying chamber-connected opening 1*c*.

The vacuum pump 7 is connected to the emission ports 1*b* and 4*e* through pipes (not shown), and emits air (gas) inside the cleaning chamber 1 and the drying chamber 4 into the outside thereof. The refrigerant supplier 8 is connected to the refrigerant intake port 4*h* through a pipe (not shown), and supplies a refrigerant to the drying chamber 4. This refrigerant is, for example, water. The recycling condenser 9 is connected to the drainage ports 1*d* and 4*f* and the vapor intake ports 1*e* and 4*g* through pipes (not shown). The recycling condenser 9 vaporizes again only the cleaning agent of the condensate liquid that includes the cleaning agent and the dirt substance and is collected from the cleaning chamber 1 and the drying chamber 4, supplies obtained vapor into the cleaning chamber 1 and the drying chamber 4, and isolates the dirt substance from the condensate liquid and concentrates the dirt substance.

Next, the operation of the vacuum cleaning apparatus 100 of this embodiment having the above configuration is described in detail.

When a workpiece is cleaned at the vacuum cleaning apparatus 100, the workpiece is carried into the cleaning chamber 1 through the workpiece passage opening 1*a*. A dirt substance such as cutting oil adheres to the surface of the workpiece. Then, the front door 3 moves so that the cleaning chamber 1 and the drying chamber 4 become a sealed space. Then, the vacuum pump 7 operates so that the internal pressures of the cleaning chamber 1 and the drying chamber 4 are decreased, and the pressure of each internal space thereof is set to a pressure (an initial pressure) of, for example, 10 kPa or less.

Parallel to the above pressure reduction process, the vapor generator 2 operates and generates cleaning vapor. The pressure of the cleaning vapor is the saturated vapor pressure thereof, and the temperature of the cleaning vapor is a temperature close to the boiling point of the cleaning liquid, for example, 80° C. to 140° C. In addition, the opening-and-closing mechanism 6 operates parallel to the above pressure reduction process so that the cleaning chamber 1 and the drying chamber 4 are divided into individual rooms, and furthermore the temperature-maintaining device 4*m* and the refrigerant supplier 8 operate so that the drying chamber temperature is set to a lower temperature (for example, 5° C. to 50° C.) than the cleaning chamber temperature at the time the cleaning is finished.

Subsequently, in this state, the cleaning vapor is supplied from the vapor generator 2 into the cleaning chamber 1 for a predetermined cleaning period, and thereby the workpiece inside the cleaning chamber 1 is cleaned. That is, contact and condensation of the cleaning vapor are continuously repeated at the surface of the workpiece during the cleaning period, and the dirt substance adhering to the surface of the workpiece flows down along with the condensate liquid formed of the cleaning vapor from the surface of the workpiece and is removed (cleaned) therefrom.

At the time the above cleaning process is finished, the pressure inside the cleaning chamber 1 becomes a pressure approximately equal to the saturated vapor pressure of the cleaning vapor, and the temperature inside the cleaning chamber 1 becomes a temperature (80° C. to 140° C.) approximately equal to the temperature of the cleaning vapor. That is, the pressure and temperature inside the cleaning chamber 1 becomes much higher values than the pressure and temperature inside the drying chamber set and maintained beforehand.

A drying process on the workpiece inside the cleaning chamber is performed subsequently to the above cleaning process. In the drying process, the opening-and-closing mechanism 6 operates so that the cleaning chamber 1 and the drying chamber 4 having the above pressure and temperature conditions communicate with each other. That is, the air cylinder 6*a* operates so that the outer circumferential edge of the valve element 6*b* is quickly moved from a state of contacting the internal surface (the surface facing the inside of the cleaning chamber) of the ring-shaped member 1*f* to a state of being separated therefrom, and thereby the cleaning chamber 1 and the drying chamber 4 are connected through a comparatively large area in a short time. That is, the valve element 6*b* is separated from the ring-shaped member 1*f*, whereby the drying chamber-connected opening 1*c* is opened, and the insides of the cleaning chamber 1 and the drying chamber 4 communicate with each other.

As a result, the pressure inside the cleaning chamber 1 is rapidly reduced, and due to this rapid pressure reduction, the condensate liquid (remaining liquid) formed of the cleaning vapor adhering to the surface of the workpiece instantaneously boils (bumps) and vaporizes, and the remaining vapor is generated. In addition, since the cleaning chamber 1 and the drying chamber 4 are connected through a comparatively large area in a short time, vapor (remaining vapor) of the remaining liquid generated from the surface of the workpiece moves at a high speed from the cleaning chamber 1 (a high-pressure area) into the drying chamber 4 (a low-pressure area) through the gap between the valve element 6*b* and the drying chamber-connected opening 1*c*, the connecting member 5 and the vapor intake opening 4*j*. Since the remaining liquid on the surface of the workpiece becomes the remaining vapor and moves into the drying chamber 4, the workpiece is dried in a short time.

Then, the remaining vapor having moved into the drying chamber 4 (a low-pressure area) condenses because the drying chamber temperature is maintained in a temperature that is lower than the cleaning chamber temperature and is lower than or equal to the boiling point of the cleaning liquid. In addition, if the surface area of members inside the drying chamber 4 is large, the temperature of the remaining vapor is easily decreased through contact between the remaining vapor and the members, and thus the condensation of the remaining vapor in the drying chamber 4 is efficiently performed.

Since the vacuum cleaning apparatus 100 of this embodiment is configured so that the valve element 6*b* closes the drying chamber-connected opening 1*c* from an inner position inside the cleaning chamber 1 than the drying chamber-connected opening 1*c*, it is possible to easily dry the workpiece compared to a case where the valve element 6*b* is provided outside of the cleaning chamber 1, for example, a case where the valve element 6*b* is configured to close the vapor intake opening 4*j* provided in the drying chamber 4.

That is, in a case where the valve element 6*b* is configured to close the vapor intake opening 4*j* provided in the drying chamber 4, since the internal space of the connecting member 5 is included in the drying target (the volume of a cleaning chamber), a wide area has to be dried. If the volume of the cleaning chamber is increased, the quantity of the cleaning liquid, which can be supplied into the cleaning chamber, increases, and thus a drying chamber having a large volume may be needed for sufficiently vaporizing the cleaning liquid, or the pressure difference between the cleaning chamber and the drying chamber may need to be increased. However, in this embodiment, since the internal space of the connecting member 5 is excluded from the drying target, the drying target is reduced, and it is possible to easily dry the workpiece together with the cleaning chamber 1.

In a case where the valve element 6*b* is provided inside the connecting member 5, the high-speed movement of vapor (remaining vapor) from the cleaning chamber 1 (a high-pressure area) into the drying chamber 4 (a low-pressure area) may be prevented because the valve element 6*b* becomes a resistance (a flow resistance). However, in this embodiment, since the valve element 6*b* is provided at an inner position of the drying chamber-connected opening 1*c* inside the cleaning chamber 1, the high-speed movement of vapor (remaining vapor) is not prevented. Additionally, in a case where the valve element 6*b* is provided inside the connecting member 5, since the air cylinder 6*a* extends rightward in FIG. 3, the size of an apparatus may increase. However, in this embodiment, it is possible to prevent the increase in size of the apparatus.

In a case where the valve element 6*b* is provided inside the drying chamber 4, the condensation performance may deteriorate because the volume of the drying chamber 4 is reduced. However, in this embodiment, since the valve element 6*b* is provided at an inner position of the drying chamber-connected opening 1*c* inside the cleaning chamber 1, it is possible to prevent the deterioration of the condensation performance.

According to the vacuum cleaning apparatus 100 of this embodiment, since the valve element 6*b* is positioned inside the cleaning chamber 1, that is, is provided at an inner position inside the cleaning chamber 1 than the ring-shaped member 1*f* (a valve seat), it is possible to reliably bring the cleaning chamber 1 a sealed state during cleaning of the workpiece compared to a case where the valve element 6*b* is provided outside of the cleaning chamber 1, that is, is provided at an outer position of the cleaning chamber 1 (at a position closer to the drying chamber 4) than the ring-shaped member 1*f* (a valve seat).

That is, although the initial pressures inside the cleaning chamber 1 and the drying chamber 4 during cleaning of the workpiece are the same, the pressure inside the cleaning chamber 1 is increased in accordance with supply of cleaning vapor as time passes. In contrast, the pressure inside the drying chamber 4 is maintained in the initial pressure, and therefore the cleaning chamber pressure (the pressure inside the cleaning chamber) becomes higher than the drying chamber pressure (the pressure inside the drying chamber) in accordance with progress of cleaning of the workpiece.

In this embodiment, since the valve element 6*b* is positioned inside the cleaning chamber 1, a pressure acts on the valve element 6*b* due to the pressure difference between the cleaning chamber pressure and the drying chamber pressure so that the valve element 6*b* is pressed on the ring-shaped member 1*f* (a valve seat). That is, not only the pulling force of the air cylinder 6*a* but the pressure based on the above pressure difference is also used for pressing the valve element 6*b* on the ring-shaped member 1*f*, and it is possible to reliably and easily seal the cleaning chamber 1. In contrast, in a case where the valve element 6*b* is positioned outside of the cleaning chamber 1, since a pressure acts on the valve element 6*b* in a direction in which the valve element 6*b* is separated from the ring-shaped member 1*f* (a valve seat), the air cylinder 6*a* connected to the valve element 6*b* has to generate a higher pressing force than the force based on the above pressure, and thus the size of the air cylinder 6*a* may increase, or it may be difficult to reliably bring the cleaning chamber 1 a sealed state.

Since the vacuum cleaning apparatus 100 of this embodiment includes the supporting member 6*d* that is provided on the connecting shaft 6*c* to be adjacent to the valve element 6*b* and slidably fits into the drying chamber-connected opening 1*c*, it is possible to maintain the optimum position of the valve element 6*b* with respect to the drying chamber-connected opening 1*c*, and thus the valve element 6*b* can reliably close the drying chamber-connected opening 1*c* during cleaning of the workpiece at the cleaning chamber 1.

According to the vacuum cleaning apparatus 100 of this embodiment, since the air cylinder 6*a* that drives the valve element 6*b* is provided in the drying chamber 4 and is connected to the valve element 6*b* inside the connecting member 5, it is possible to reliably drive the valve element 6*b* positioned inside the cleaning chamber 1.

According to the vacuum cleaning apparatus 100 of this embodiment, the connecting member 5 is configured as a bellows. Therefore, even when at least one of the cleaning chamber 1 and the drying chamber 4 deforms due to heat and the relative position between the cleaning chamber 1 and the drying chamber 4 is changed, the connecting member 5 can deform and absorb the change in the relative position, and thus it is possible to reduce the impact on each other.

Hereinbefore, although an embodiment of the present disclosure is described with reference to the attached drawings, the present disclosure is not limited to the above embodiment. The shape, the combination or the like of each component shown in the above embodiment is an example, and addition, omission, replacement, and other modifications of a configuration based on a design request or the like can be adopted within the scope of the present disclosure. For example, the following modifications may be adopted.

(1) In the above embodiment, although the supporting member 6*d*, which determines the position of the valve element 6*b* with respect to the drying chamber-connected opening 1*c*, is provided, the present disclosure is not limited thereto. If the outer diameter of the valve element 6*b* is sufficiently greater than the drying chamber-connected opening 1*c*, the supporting member 6*d* need not be provided.

(2) In the above embodiment, although the valve element 6*b* and the supporting member 6*d* are individually provided, they may be unified.

(3) In the above embodiment, although the connecting member 5 is a bellows, the present disclosure is not limited thereto. If the thermal deformation of each of the cleaning chamber 1 and the drying chamber 4 is ignorable, the connecting member 5 may be a general straight pipe.

(4) In the above embodiment, the fins 4*k* are attached to the inner wall 4*a*2 of the first flat surface portion 4*a* including the double shell structure, and cleaning vapor (remaining vapor) is condensed at the fins 4*k* and the inner wall 4*a*2. However, the first flat surface portion 4*a* (and the circumferential surface portion 4*c*) may include a single shell structure, and a structure may be adopted in which a heat exchanger is disposed inside the drying chamber 4 instead of the fins 4*k*, and the heat exchanger includes copper tubes through which a refrigerant flows, and fins attached to the copper tubes.

INDUSTRIAL APPLICABILITY

The present disclosure can be applied to a cleaning apparatus that cleans an object to be cleaned accommodated inside a cleaning chamber with a cleaning agent.

The invention claimed is:

1. A cleaning apparatus comprising:
- a cleaning chamber that accommodates an object to be cleaned;
- a drying chamber connected to the cleaning chamber;
- a connecting member connecting a first opening provided in the cleaning chamber and a second opening provided in the drying chamber;
- a valve element positioned inside the cleaning chamber and facing the first opening;
- a valve seat facing the valve element; and
- an actuator that drives the valve element,
- wherein the valve element is configured to be separated from the valve seat inward of the cleaning chamber.

2. The cleaning apparatus according to claim 1, further comprising
- an opening-and-closing mechanism that switches the connecting member, which connects the first opening provided in the cleaning chamber and the second opening provided in the drying chamber, between a communicating state and a non-communicating state;
- wherein the valve seat includes the first opening, and
- wherein the opening-and-closing mechanism includes the valve element, the valve seat and the actuator, and is configured to allow the cleaning chamber and the drying chamber to communicate with each other by separating the valve element and the valve seat from each other.

3. The cleaning apparatus according to claim 1, further comprising a supporting member that slidably fits into the first opening and determines the position of the valve element with respect to the first opening.

4. The cleaning apparatus according to claim 1, wherein the actuator is provided in the drying chamber and is connected to the valve element inside the connecting member.

5. The cleaning apparatus according to claim 1, wherein the connecting member is a bellows.

6. The cleaning apparatus according to claim 1, wherein the valve element is configured to be movable relative to the object to be cleaned accommodated inside the cleaning chamber.

7. The cleaning apparatus according to claim 1, wherein the actuator is provided in the drying chamber, and wherein the cleaning apparatus is configured to dry the object to be cleaned by allowing the cleaning chamber and the drying chamber, the drying chamber having an internal pressure lower than an internal pressure of the cleaning chamber, to communicate with each other through the actuator separating the valve element from the valve seat.

* * * * *